United States Patent [19]

Hastrup

[11] 4,019,546

[45] Apr. 26, 1977

[54] ROTARY PACKER AND METHOD OF FILLING BAGS

[75] Inventor: Niels E. Hastrup, Copenhagen Valby, Denmark

[73] Assignee: F. L. Smidth & Co., Cresskill, N.J.

[22] Filed: July 17, 1975

[21] Appl. No.: 596,599

[30] Foreign Application Priority Data

July 18, 1974 United Kingdom ..... 31953/74

[52] U.S. Cl. ..... 141/10; 141/114; 141/314; 53/188

[51] Int. Cl.[2] ..... B65B 1/04

[58] Field of Search ..... 141/10, 67, 68, 114, 141/313–317; 53/188, 189, 190, 386

[56] References Cited

UNITED STATES PATENTS 2,833,097 5/1958 Petrea et al. ..... 53/188

*Primary Examiner*—Houston S. Bell, Jr.
*Attorney, Agent, or Firm*—Pennie & Edmonds

[57] ABSTRACT

A method is disclosed for introducing material such as cement into sacks of the valve type which are positioned in a magazine adjacent a rotary packing means having a plurality of material filling spouts distributed thereabout and means to supply the material to the spouts. The method relates to positioning the sack magazine adjacent the rotary packing means in a manner such that the foremost sack is positioned adjacent the rotary path defined by the spouts while rotating the rotary packing means in a direction such that the spouts successively and repeatedly approach the bag carrying means in the general direction of rotation. The method further comprises orienting each filling spout relative to the rotary packing means and to the bag carrying means such that the spouts approach the general direction of the opening of the bag closest thereto and successively opening the mouth portion of the foremost bag thereby permitting each approaching spout to enter the opening of the bag and to transport the bag away from its carrying means as the packing means continues to rotate. The cement material is introduced from the filling spout into the bag as it is positioned about the spout. A novel apparatus is disclosed for practicing the inventive method.

40 Claims, 6 Drawing Figures

ROTARY PACKER AND METHOD OF FILLING BAGS

BACKGROUND OF THE INVENTION

1. Field of the Invention

This invention relates to a method of filling bags such as sacks which define at least one opening at one end and an apparatus for carrying out the inventive method.

2. Description of the Prior Art

Rotary packers often comprise a number of filling spouts from which the sacks are suspended, or beneath which the sacks are placed and supported by means of a sack bracket, during filling. The filling spouts are usually uniformly distributed in a circle and rotated about the verticle axis of the packer. The empty sacks are usually placed manually on the filling spouts by an operator whose only task is to pick an empty sack from a sack magazine and to place the empty sack on an empty filling spout as it passes him. All other operations of the packing machine, including filling of the sack, usually to a predetermined weight, and the discharge and removal of the filled sacks, are automatic.

It is also known to automate the manual operation by providing a gripping mechanism adapted to take one empty sack at a time from the sack magazine and to open the valve opening of the sack on or opposite an empty filling spout. The automation for this particular purpose is, however, highly complicated and requires much space as well as being costly as an initial investment and in its operation.

Swiss Pat. No. 240,697 relates to an apparatus for filling powdered material into containers. Powdered material is lifted by stirring elements from the bottom of a material supply tank up to its top edge. This material leaves the tank in the form of a number of jets through outlet connections which also serve as attachments for the containers into which the material flows. The containers are placed on the outlet connections manually and removed after being filled to a predetermined weight.

U.S. Pat. No. 1,903,188 to Middelboe relates to a machine for filling valve bags with a definite weight of pulverous material. A filling tank rotatably arranged about a vertical axis is combined with a number of filling spouts which extend from the lower part of the filling tank. The filling spouts are adapted to serve as a carrier and feeding device for the valve bags which are attached thereto by an operator, and each spout is supplied with a flow cut-off mechanism controlled by a weighing mechanism.

German Pat. No. 1,255,562 relates to a packing machine for filling bulk material into bags which has a device for feeding bags from a magazine to a filler cap. This feeding device consists of a frame rigidly connected to the packing unit. The frame carrier has a guide bar arranged in a plane located above both the filler cap and a magazine which is spaced a certain distance away from the rotary packer. A truck having a catch to engage the top bag in the magazine moves back and forth on this guide between the bag magazine and a filler spout.

According to my invention material is introduced into bags such as sacks in a manner which provides a substantial saving in time. The preferred arrangement is fully automatic thereby rendering the manual operation in placing of the sacks on the filling spouts superfluous. Further, the fully automatic plant is uncomplicated, requires limited space, and has a low primary cost and low cost of operation.

SUMMARY OF THE INVENTION

In accordance with the invention material is introduced into bags such as sacks positioned in a carrying means which define an opening forming a mouth with or at least part of a valve opening at one end for introducing material therein. The method utilizes a rotary packer having a rotary packing means with a plurality of material filling spouts distributed about the circumference and means to supply the material to the spouts.

The method comprises positioning the bag carrying means adjacent the packing means in a manner such that at least one bag is positioned adjacent the rotary path defined by said spouts and rotating the rotary packing means about its axis in a direction such that the material filling spouts successively approach the bag carrying means in the direction of rotation. The method further comprises orienting each filling spout relative to the rotary packing means and to the bag carrying means such that at least a portion of each spout approaches the general direction of the opening of the bag closest thereto while approaching the bag carrying means, and successively permitting each spout to enter the opening of the bag closest to the spout and to transport the bag away from its carrying means as the rotary packing means is rotated. The material is introduced from the filling spout into each bag as the bag is positioned about the filling spout.

In the preferred embodiment the bags are in the form of valve sacks positioned in stacked relation in a sack magazine and the mouth of the next sack to be lifted from the magazine is automatically opened such that at least a portion of the sack is positioned within the rotary path defined by the filling spouts. Thus a given spout will slide into the sack mouth as it rotates past the magazine and thereby pick up the sack from the magazine and carry the sack with it while introducing material into the sack via its valve opening.

The invention also pertains to a rotary packer for introducing material into bags such as sacks, each bag defining at least one opening at one end portion for introducing the material therein. The rotary packer comprises a packing means rotatably mounted about a rotational axis and having a plurality of filling spouts distributed uniformly about the filling means. The filling spouts communicate with a supply of the material which is to be introduced into the bags. The invention further comprises means for retaining a plurality of bags positioned adjacent the rotary path defined by the filling spouts and the filling spouts are so arranged and oriented such that at least a portion of each spout face generally the direction of rotation of the packing means and the opening of the bag positioned closest to the rotary path defined by the filling spouts. The rotary packer of the present invention further comprises means to successively open the bag closest to the path defined by the filling spouts in a manner such that each spout approaching the bag retaining means enters the bag for the purpose of introducing a material therein.

An essential feature of the invention is the use of forwardly directed spouts which enables the filling spouts to be inserted into the sack mouths by the rotary movement of the spouts, as opposed to the use of a gripping mechanism that pushes the sacks onto the spouts. The use of the inventive rotary packer and the method according to the invention thus results in an economy in time, particularly in the automatic lifting of the sacks, which enables the operation to be performed at a speed corresponding at least to the speed hitherto achieved by manually placing of the sacks by a trained operator. The invention is equally applicable to the case in which the sacks are wholly supported during filling by suspension from the spouts and that in which the sacks are at least partly supported during filling by sack brackets.

A rotating packer is often provided with a central container rotating with the packer and containing the material to be fed into the sacks. From the bottom of the container connecting pipes or hoses lead to the filling spouts.

In a packer equipped in this manner each filling spout may be movably mounted relatively to the container and provided with a turning device such that after picking up a sack the spout is turned from a position in which its mouth is directed forwardly in the direction of rotation to a position in which its mouth is directed substantially radially outwardly of the packer axis, and is turned back again after a filled sack has been discharged from that spout and before that spout reaches the magazine again to pick up another sack. This enables a larger number of spouts to be accommodated in a circle of given radius without adjacent sacks that are being filled interfering with one another.

The means for opening and locating the mouth of a sack in the path of movement of the filling spouts may comprise a gripping mechanism which is mounted adjacent to the magazine and has movable means which is arranged in use successively to grip the foremost sack in the magazine and to open the sack mouth and move the sack mouth into the path of movement, and, when the sack has been picked up by a passing filling spout, to make a return movement to grip the next sack.

Alternatively, the magazine is arranged to present the stack of sacks that the foremost sack mouth will be located immediately below the circular path of the mouths of the rotating filling spouts and the means for opening and locating the mouth of a sack in the path of movement of the filling spouts may comprise a compressed air device which is positioned adjacent to the magazine and arranged in use to direct a jet of air into the mouth of the foremost sack in the magazine. The jet of compressed air expands the mouth of the sack into the path of movement of the filling spouts, there being a holder mechanism resting in contact with the foremost sack while in the magazine so as to prevent the air blown into the sack mouth from expanding the sack body.

Furthermore, it is advantageous if the magazine is arranged to advance upwardly, an upright stack of empty sacks with the sacks inclined downwardly away from their mouth end portions and is provided with retaining means for engaging both the mouth end portion and the opposite end of the foremost sack in the magazine. Preferably the filling spouts approach the magazine at that side at which the mouth end portions of the sacks are positioned with the mouth parts of the filling spouts at a smaller angle to the horizontal than the sacks, whereby in use as a filling spout slides into the foremost sack mouth the opposite end portion of the sack is released from the retaining means but the mouth end portion of the sack is only subsequently released from the retaining means when the filling spout has fully entered the sack mouth, and the holder mechanism being arranged to give away as the sack is picked up has the filling spout.

The packer may also have an automatic gripping device which is arranged in use to remove the foremost sack from the magazine if the mouth of the sack has not been expanded by the compressed air device and the sack has not been picked up by a passing filling spout.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
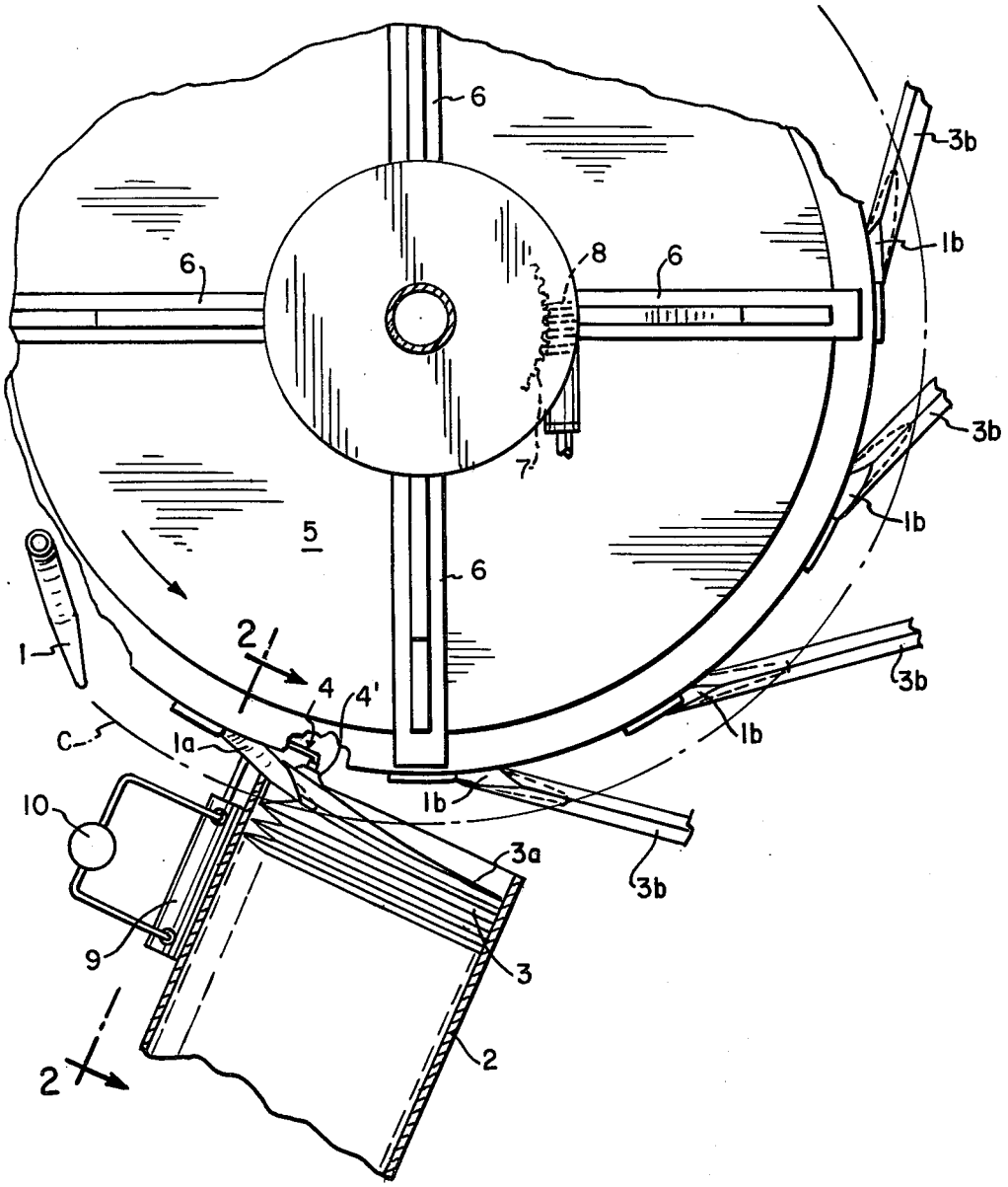
FIG. 1 is a top view, partly in section, of a rotary packer with substantially tangentially arranged filling spouts and part of a sack magazine with a corresponding gripping mechanism.

The rotary packer, shown in FIG. 1, has a circular array of filling spouts 1 each oriented substantially tangentially to their circle of distribution. The spouts are shown in their position prior to (1), during (1*a*) and after (1*b*) picking up a sack. Sacks being taken from a bag carrying means are shown prior to (3), during (3*a*) and after (3*b*) being picked up. A gripping mechanism 4, in this embodiment fitted with a suction cup 4′, is capable of picking the foremost sack from the carrier, opening its mouth and placing the sack in the circular path *c* of the mouths of the rotating filling spouts. The filling spouts 1 are connected to a rotating container 5 for the material, e.g. cement, to be fed into sacks and the container 5 is supported by suspension brackets 6. The container is rotated via a gear 7 and a driving shaft 8 in the direction indicated by the arrow in FIG. 1. The driving shaft 8 may be in the form of a worm gear or any other suitable drive means such as a combined shaft and drive gear.

Figure 2:
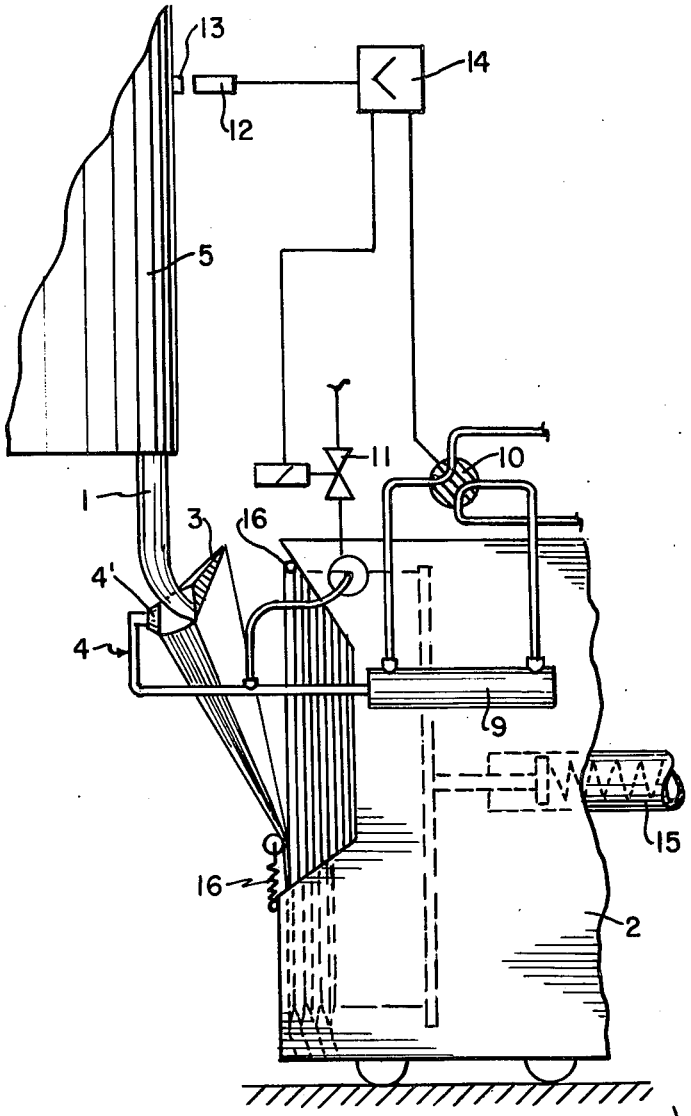
FIG. 2 is a section taken along line 2—2 of FIG. 1 supplemented by the automatic control devices of the gripping mechanism shown partly diagrammatically.

FIG. 2 illustrates the control and regulating means for the gripping mechanism 4 and the sack magazine 2. The gripping mechanism 4 is moved by a double acting pneumatic cylinder 9 controlled by a valve 10. The vacuum at the suction cup 4′ is controlled through a two-way valve 11. An electric sensor 12 cooperates with cams 13 which are provided on the rotating container. The electric sensor 12 and cams 13 provide signals for controlling the gripping mechanism, via a combined amplifier and relay box 14 so as to synchronize the reciprocating movements of the gripping mechanism and its removal of the sacks from the sack magazine 2 with the passage of the filling spouts past the magazine. In the illustrated embodiment the carrier is in the form of a cassette provided with a spring activated advancing mechanism 15 for the sacks which automatically presses the sacks forward in the direction of the open end of the cassette which is provided with spring activated holders 16 to retain the sacks in position until they are seized by the gripping mechanism 4.

Figure 3:
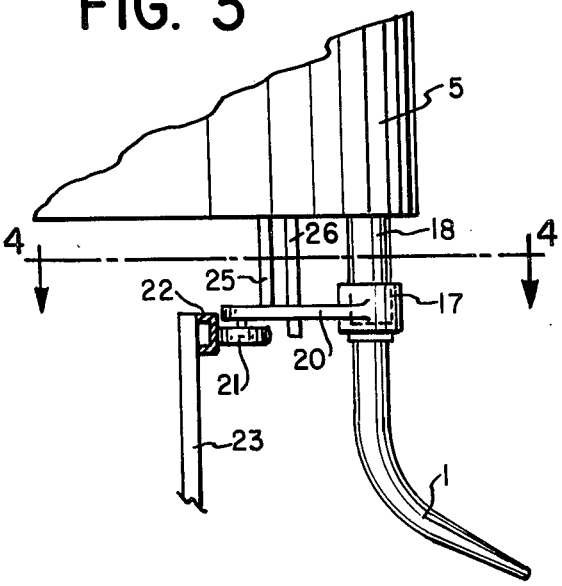
FIG. 3 is a side-view of a modified filling spout with corresponding turning mechanism.
Figure 4:
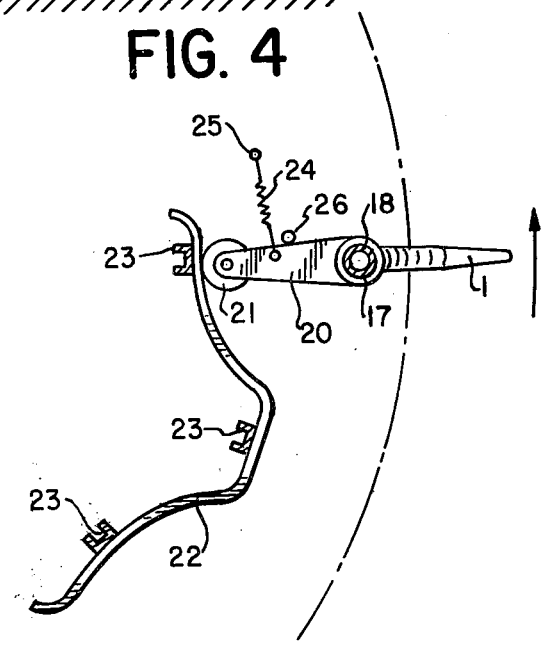
FIG. 4 is a section taken along line 4—4 of FIG. 3.

FIGS. 3 and 4 show a modified filling spout with means for turning the spout in a horizontal plane thereby enabling the filling spout to adopt a tangential or radial position in relation to the circle of distribution. The spout 1 is rotatable, by means of a connection 17, on a outlet pipe 18 of the container 5. A bar 20 is attached at one end to the socket 17 and carried at its other end by a wheel 21 resting in contact with a cam 22. The cam 22 is stationary in relation to the rotating packer and is mounted on bars 23 as shown.

Referring now to FIG. 4, spring 24 is attached at one end to the bar 20 and at its other end to a bar 25 which projects from the container bottom. The spring keeps the filling spout in its radial position with the bar pressed against a stop 26. When the wheel 21 engages the cam 22, the bar 20 turns against the action of the spring 24, and consequently turns the socket 17 and spout 1 into its tangential position. When the spout has passed the sack magazine, the action of the spring 24 returns the socket 17 and spout 1 to the radial position and presses the bar 20 against the stop 26.

Figure 5:
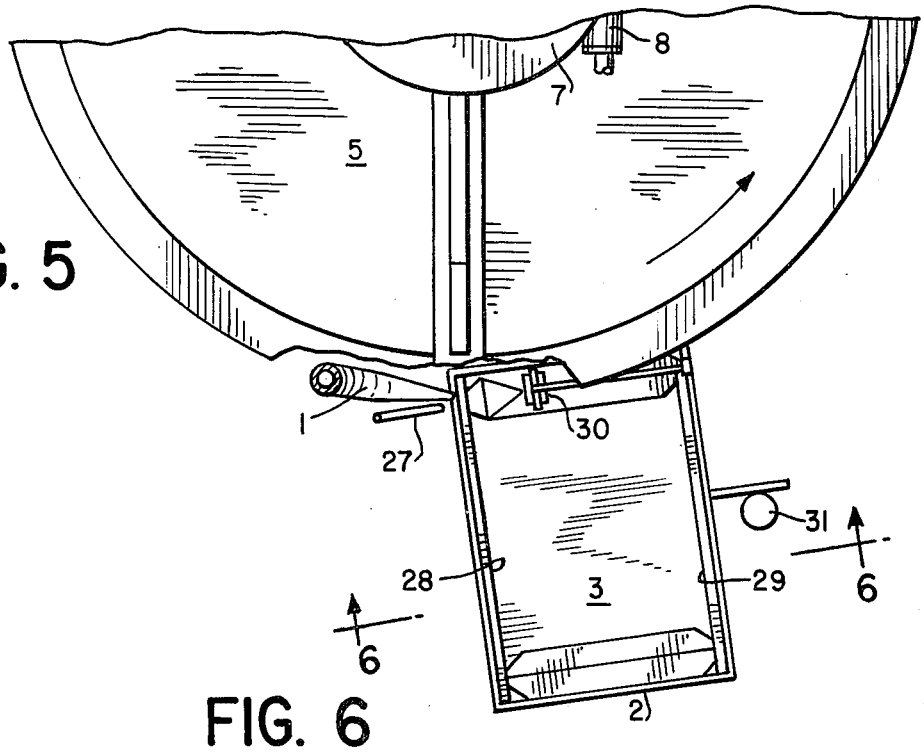
FIG. 5 is a top view partly in section, of a modification of the packer shown in FIG. 1.
Figure 6:
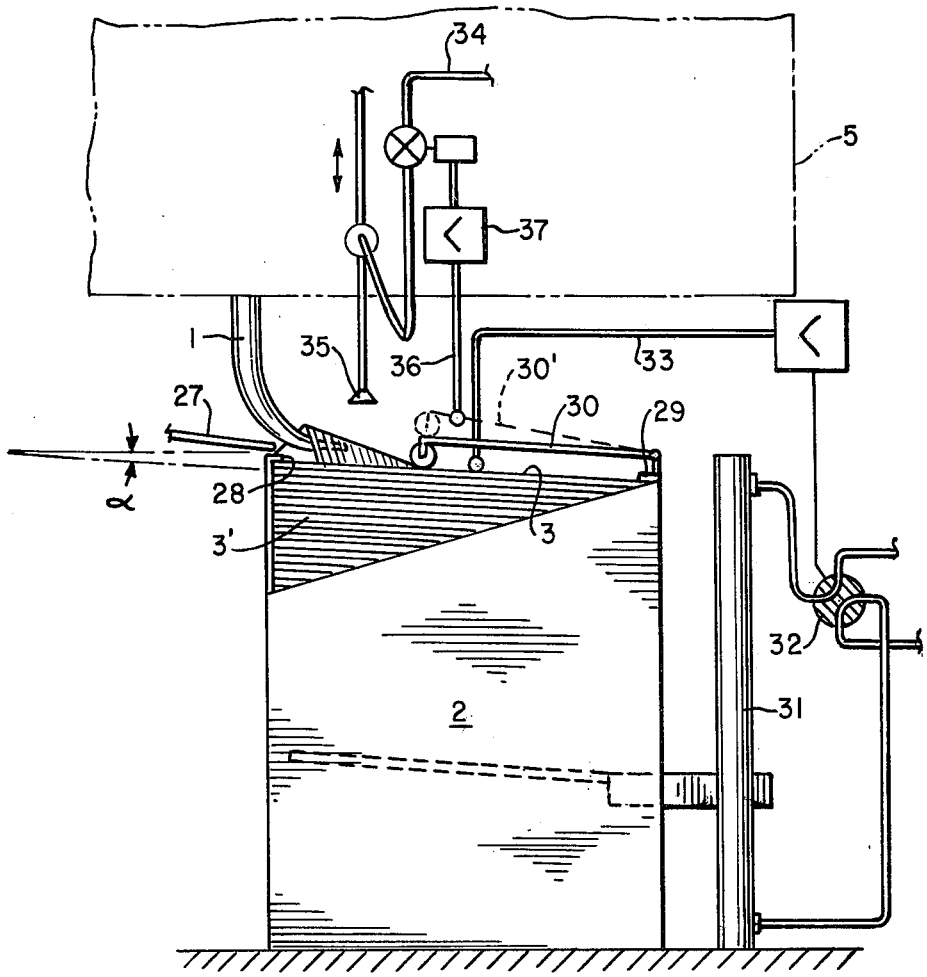
FIG. 6 is a section taken along line 6—6 of FIG. 5.

Referring now to FIGS. 5 and 6, the mouth of the foremost sack — i.e. closest to the rotary packet — in the magazine 2 is being placed in the path of the rotating filling spouts without use of a gripping mechanism. In this embodiment the foremost sack 3 contained in a sack carrier 2 is shown with an open mouth forming part of a valve and with a filling spout 1 entering the open mouth. Retaining means 28 and 29 engage the ends of the sack 3.

Referring now to FIG. 6, a sack magazine 2 holds a stack 3′ of empty sacks. The stack 3′ is advanced upwards with the sacks at an inclination to the horizontal. Before the filling spout 1 slides into the sack mouth, the valve is opened by a jet of compressed air from a device 27. The angle of inclination of the sack is greater than the corresponding angle of inclination of that part of the filling spout which slides into the sack mouth while the sack is extracted from the magazine.

Because of the difference in the angle of inclination $\alpha$ of the spout 1 and the sack 3, as the filling spout 1 enters into the open sack mouth, it raises that end of the sack 3 which is opposite the mouth end, clear of the successive sack of the stack. The retaining means 29 releases the sack 3 as the filling spout begins to move into the sack mouth while the retaining means 28 retains the sack until the filling spout has been wholly inserted into the mouth. Immediately before a free filling spout passes the stack of sacks the mouth of the foremost sack 3 is opened by means of a compressed air impulse directed into the mouth of the sack 3 by a compressed air device 27.

A holder mechanism 30 rests in contact with the foremost sack 3 so as to prevent air blown into the sack mouth from expanding the sack proper. The contact member of the holder mechanism 30, resting in contact with the sack 3, may be formed as a roller. The mechanism may be mounted on the container base or, as shown in FIG. 6, it may rest on the sack magazine 2 by means of a spring-activated hinge which — acting together with the roller — allows the holder mechanism to give way to the reaction of the filling spout 1 as the spout picks up and carries away the sack 3, as indicated by the stippled line 30′.

A sensor mechanism 33 is provided to ensure that an hydraulic or pneumatic advancing mechanism 31 for the stack 3′ of sacks in the magazine 2, automatically advances the stack of sacks upwards so that the mouth of the sack 3 is located in the circular path of the mouth of the rotating filling spouts. The advancing mechanism is driven by a change-over valve 32 connected to the advancing mechanism by pipe or hose means.

A gripping mechanism 34, which has a suction cup 35 and a sensor means 36 and which is mounted adjacent the magazine 2, may remove the foremost sack 3 from the stack if the sack mouth is not opened by the compressed air mechanism 27. In this event the holder mechanism 30 will be brought into direct contact with the filling spout 1 by its roller as shown. In this case there will be no wall portion of the sack between the roller and the spout as is usually the case where the sack acts as an insulating layer therebetween. When the holder mechanism then engages the sensor means 36 as indicated at 30′ an electrical circuit is closed and the gripping mechanism 34 is activated through a combined amplifier and relay box 37 in order to remove the sack.

I claim:

1. A method of introducing material by means of a rotary packer into bags such as sacks defining at least one opening at one end portion and positioned in at least one carrying means including rotary packing means having a plurality of bag filling spouts positioned about peripheral portions so as to be rotatable therewith, said spouts further being movable from positions generally radial relative to said rotary packing means toward positions generally tangential relative to peripheral portions of said rotary packing means, means to supply material to said spouts for filling said bags with material to predetermined levels comprising:

a. positioning said bag carrying means adjacent said rotary packing means in a manner such that at least one bag is positioned at least adjacent a path defined by said spouts;

b. rotating said rotary packing means about its axis in a direction such that said bag filling spouts traverse a generally arcuate path and successively approach said bag carrying means in the direction of rotation;

c. successively rotating each bag filling spout about an axis associated therewith toward positions generally tangential relative to peripheral portions of said rotary packing means such that at least a portion of each bag filling spout approaches the general direction of said opening of the bag closest thereto while approaching said bag carrying means;

d. successively permitting each bag filling spout to enter said opening of the bag closest to said spout and transporting said bag therewith away from said bag carrying means as said rotary packing means is rotated; and e. introducing material from said filling spout into said bag as said bag is positioned about the filling spout and transported away from the bag carrying means.

2. The method according to claim 1 further comprising positioning bags in said bag carrying means in a manner such that said bags are adjacent the generally arcuate path defined by said bag filling spouts, and gripping the bag closest to said generally arcuate path and, opening an end portion of said bag into said generally arcuate path defined by said filling spouts.

3. The method according to claim 1 further comprising positioning the bag carrying means beneath said rotary packing means in a manner such that said open end portion of the foremost bag is closest to the generally arcuate path defined by said filling spouts.

4. The method according to claim 2 further comprising successively automatically gripping said foremost bag from said bag carrying means with an automatically controlled gripping mechanism provided with a suction cup capable of removing at least a portion of the bag closest to said bag filling spout from said bag carrying means in a manner to open said end portion of said bag and positioning at least a portion of said bag in said generally arcuate path defined by said filling spouts.

5. The method according to claim 3 further comprising successively automatically directing a jet of air into said open end portion of said bag nearest the approaching bag filling spout thereby opening at least said end portion of said foremost bag and expanding at least a portion of said bag into said rotary path defined by said bag filling spouts.

6. The method according to claim 5 further comprising preventing the air blown into said foremost bag from expanding the entire bag body.

7. The method according to claim 3 further comprising inclining said bags in said bag carrying means such that their open end portions are closest to said generally arcuate path of said bag filling spouts.

8. The method according to claim 7 further comprising rotating the rotary packing means about a vertical axis and positioning the open mouth portion of said bag filling spouts at an angle relative to a horizontal plane less than the angle defined by said bags and said horizontal plane.

9. The method according to claim 8 further comprising retaining said end portion and the opposite end portion of said foremost bag in said bag carrying means in a manner such that entry of a bag filling spout into said open end portion of said foremost bag causes the opposite end portion to be lifted from said bag carrying means prior to releasing said end portion from said bag carrying means.

10. The method according to claim 9 further comprising removing from said bag carrying means a foremost bag not removed by a passing bag filling spout.

11. The method according to claim 10 further comprising filling each bag with said material to a predetermined level while positioned about said bag filling spout, and discharging said bag from said bag filling spout prior to return of said bag filling spout to said bag carrying means along said generally arcuate path.

12. The method according to claim 1 further comprising successively rotating each bag filling spout from positions generally tangential to peripheral portions of said rotary packing means toward positions generally radial to said rotary packing means at least until a bag filled with material to a predetermined level is discharged from said bag filling spout.

13. The method according to claim 1 comprising successively rotating each bag filling spout about an axis associated therewith toward positions generally tangential relative to the circumference of said rotary packing means such that at least a portion of each bag filling spout approaches the general direction of an opening of the bag closest thereto, permitting each bag filling spout to enter the foremost bag, filling said bag at least to a predetermined level, and rotating said spout to positions generally radial of the circumference of said rotating packing means while supporting said bag on said spout.

14. The method according to claim 12 further comprising supporting said sacks during filling by suspending said sacks from said spouts.

15. The method according to claim 1 further comprising at least partially supporting said sacks during filling by bracket means.

16. A method of introducing cement material by means of a rotary packer into valve sacks defining at least one opening forming a valve at one end portion thereof and positioned in at least one carrying means including rotary packing means having a plurality of sack filling spouts distributed substantially uniformly about the circumference of said rotary packing means so as to be rotatable therewith, said sack filling spouts further being rotatable from positions generally radial to the circumference of said rotary packing means toward positions generally tangential to the circumference thereof, means to supply material to said spouts for filling said valve sacks with material to predetermined levels comprising:

a. positioning said sack carrying means adjacent said rotary packing means in a manner such that at least one valve sack is positioned adjacent the generally rotary path defined by said sack filling spouts;

b. rotating said rotary packing means about its axis in a direction such that said sack filling spouts traverse a generally rotary path and successively approach said sack carrying means in the direction of rotation;

c. successively rotating each sack filling spout about an axis associated therewith toward positions generally tangential to the circumference of said rotary packing means such that at least a portion of each sack filling spout faces the general direction of said opening of said valve sack closest thereto while approaching said sack carrying means;

d. orienting said valve sacks within said sack carrying means at angular positions which facilitate entry of each sack filling spout into the sack closest to the generally rotary path defined by said sack filling spouts;

e. successively automatically opening at least partially the mouth portion of the foremost sack positioned adjacent the generally rotary path defined by said sack filling spouts thereby permitting each sack filling spout to enter said opening of the sack closest to said sack filling spout and transporting said sack away from said sack carrying means as said rotary packing means is rotated;

f. advancing said remaining sacks toward said rotary packing means so as to position the second sack to the foremost sack position;

g. supporting each sack about said sack filling spout;

h. introducing cement material from said sack filling spout into each sack as said sack is transported away from said sack carrying means while positioned about said sack filling spout; and i. successively rotating each sack filling spout from positions generally tangential relative to the circumference of said rotary packing means toward positions generally radial relative to said rotary packing means at least until a sack filled with cement material to a predetermined level is discharged from said sack filling spout.

17. A rotary packer for introducing material into bags such as sacks, each bag defining at least one opening at one end portion for introducing the material therein which comprises:

a. packing means rotatably mounted about a rotational axis;

b. a plurality of filling spouts positioned about peripheral portions of said packing means so as to be rotatable therewith, said filling spouts further being movable from positions radial relative to said rotary packing means toward positions generally tangential relative to peripheral portions of said rotary packing means;

c. means to supply material to said filling spouts to fill said bags with said material to predetermined levels;

d. means for carrying a plurality of bags positioned adjacent the generally arcuate path defined by said filling spouts, said filling spouts being so arranged and oriented that at least a portion of each filling spout faces generally the direction of rotation of said packing means and an opening of the bag positioned closest to the path defined by said filling spouts;

e. means to successively open the bag closest to the path defined by said filling spouts in a manner such that each spout approaching the bag carrying means enters said bag opening to introduce material from said filling spout into said bag and to transport said bag away from said bag carrying means while said packing means is rotated about its axis; and f. means to rotate each filling spout about an axis associated therewith toward positions generally tangential relative to peripheral portions of said rotary packing means.

18. The rotary packer according to claim 17 wherein said retaining means retains said bags and said filling spouts are adapted such that said spouts successively enter the foremost bag and transport said bag away from said retaining means.

19. The rotary packer according to claim 18 further comprising means to secure said bag to said rotary packing means while said filling spout is positioned within said bag opening such that each bag is transported away from said bag carrying means while material is introduced therein by said filling spout.

20. The rotary packer according to claim 18 wherein said bag carrying means is a magazine positioned and adapted to retain a plurality of empty bags in stacked relation and in a manner such that the mouth of the foremost bag is located below the generally arcuate path of said rotating filling spouts.

21. The rotary packer according to claim 17 wherein said bag carrying means is a magazine positioned and adapted to retain a plurality of empty bags in stacked relation and in a manner such that the mouth of the foremost bag is located adjacent the generally arcuate path of said rotating filling spouts.

22. The rotary packer according to claim 20 further comprising means positioned adjacent the bag magazine to successively emit and direct air into said open end portion of the foremost sack in said bag magazine in timed relation to the rotation of said rotary packing means to expand said end portion of said bag into the path of said rotating filling spouts.

23. The rotary packer according to claim 2 wherein said means to direct air into the foremost bag comprises a device to direct a jet of compressed air.

24. The rotary packer according to claim 23 further comprising means to prevent the compressed air blown into the mouth of each bag from entering and expanding said bag body.

25. The rotary packer according to claim 22 wherein said bag magazine comprises means to advance a stack of empty bags toward the generally arcuate path of said filling spouts in such manner that the sacks are inclined from their mouth ends.

26. The rotary packer according to claim 25 wherein said magazine further comprises bag retaining means adapted to engage both end portions of said foremost bag in said magazine to retain the bags in stacked relation.

27. The rotary packer according to claim 17 wherein said filling spouts are distributed substantially uniformly about the circumference of said rotary packing means.

28. The rotary packer according to claim 17 wherein said rotary packing means is in the form of a container rotatably mounted about a substantially vertical axis.

29. The rotary packer according to claim 17 wherein each filling spout is movable from positions generally radial relative to said rotary packing means towards positions generally tangential to the circumference of said rotary packing means.

30. The rotary packer according to claim 29 further comprising means to engageably retain the mouth end portion and opposite end portion of the foremost bag in position in said magazine to retain the empty bags in stacked relation with means being provided to orient the filling spouts at an angle relative to a horizontal plane less than the angle formed therewith by each bag such that when each filling spout enters the next successive bag mouth and the opposite end portion of said foremost bag is released from said retaining means when the filling spout subtantially fully enters the bag mouth, said bag retaining means being adapted to release the foremost bag as it is lifted away from said magazine by said filling spout.

31. The rotary packer according to claim 17 wherein said bag carrying means is a sack magazine positioned and adapted to retain empty sacks in stacked relation and in a manner such that the mouth of the foremost sack is positioned immediately adjacent the generally arcuate path of said rotating bag filling spouts.

32. The rotary packer according to claim 31 further comprising gripping means mounted adjacent said magazine and having movable means arranged and adapted to grip the foremost sack in said magazine and to open the mouth end portion of the sack while positioning at least a portion of the mouth into the rotary path of movement of said filling spouts.

33. The rotary packer according to claim 32 wherein said gripping means further comprises means to return said movable gripping mechanism to its rest position to grip the next successive sack after the foremost sack is transported away from said magazine by a filling spout.

34. The rotary packer according to claim 33 wherein said bag magazine is adapted to carry a stack of valve-type cement sacks with means being provided to advance the stack of empty sacks toward the generally arcuate path of said filling spouts as each foremost sack is removed by a passing filling spout.

35. The rotary packer according to claim 34 further comprising means to retain a plurality of empty sacks in inclined stacked orientation in relation to said rotary packing means, with the mouth portion of each sack being closest to the generally arcuate path of said filling spouts.

36. The rotary packer according to claim 35 further comprising means to retain the mouth end portion and opposite end portion of said stack of empty sacks in said magazine.

37. The rotary packer according to claim 24 further comprising automatic gripping means adapted to automatically remove each successive foremost bag from said bag magazine not expanded by said compressed air means.

38. The rotary packer according to claim 35 further comprising automatic gripping means adapted to automatically remove each successive foremost sack from said magazine not expanded by said gripping means.

39. A rotary packer for introducing cement material into valve sacks, each sack defining at least one opening which forms part of a valve for introducing the cement material therein which comprises:

a. a container rotatably mounted about a substantially vertical axis for rotation;

b. a plurality of sack filling spouts distributed substantially uniformly about circumferential portions of said container so as to be rotatable therewith;

c. a supply of cement material disposed in said container;

d. means for communicating said filling spouts with the supply of cement material for directing said cement material to said filling spouts for discharge by said filling spouts;

e. a magazine for retaining a plurality of said valve sacks in stacked relation adjacent the generally rotary path defined by said filling spouts;

f. axial connector means for enabling each filling spout to swivel individually between positions generally radial relative to said container and positions generally tangential to the circumference of said container;

g. means for successively rotating each filling spout about an axis asociated therewith toward positions generally tangential relative to the circumference of said container such that at least a portion of each filling spout approaches the general direction of the mouth portion of the sack closest thereto to permit each spout to enter the foremost sack to fill said sack at least to a predetermined level and for rotating said filling spout to positions generally radial of the circumference of said rotating container at least until a sack filled with cement material to a predetermined level is discharged from said filling spout;

h. means mounted adjacent said magazine including at least one suction cup for automatically gripping the valve sack closest to the rotary path defined by said filling spouts and opening said mouth portion of said sack into the path of said filling spouts in a manner such that the spout approaching said sack closest thereto enters the sack opening and removes said sack from said magazine and introduces a predetermined amount of cement material therein as the sack is transported away from said magazine; and i. means for discharging said sack from said filling spout when sack is filled at least to a predetermined level.

40. A rotary packer for introducing cement material into valve sacks, each sack defining at least one opening which forms part of a valve for introducing the cement material therein which comprises:

a. a container rotatably mounted about a substantially vertical axis for rotation;

b. a plurality of filling spouts distributed substantially uniformly about the circumference of said container so as to be rotatable therewith;

c. a supply of cement material disposed in said container;

d. means for communicating said supply of cement material with said filling spouts for directing said cement material to said filling spouts for discharge by said filling spouts;

e. axial connector means to enable each filling spout to swivel individually between positions generally radial relative to said container and positions generally tangential to the circumference of said container;

f. cam means for successively rotating each filling spout about an axis associated therewith toward positions generally tangential relative to the circumference of said container such that each filling spout approaches the general direction of the mouth portion of the sack closest thereto permitting each spout to enter the foremost sack to fill said sack at least to a predetermined level and for rotating said filling spout to positions generally radial of the circumference of said rotating container at least until a sack filled with cement material to a predetermined level is discharged from said filling spout;

g. a magazine for retaining a plurality of said valve sacks in vertical stacked relation immediately below the rotary path defined by said filling spouts;

h. means positioned adjacent said magazine for automatically and periodically directing a jet of compressed air into the mouth portion of the sack positioned closest to the rotary path defined by said filling spouts in timed relation with the rotation of said spouts so as to open the mouth portion of the sack closest to each approaching spout immediately prior to arrival of said filling spout at the location of said closest sack such that said filling spout enters said sack and lifts said sack away from said magazine for introducing a predetermined amount of cement material therein;

i. means to prevent the jet of compressed air from expanding the entire body of the foremost sack;

j. means engageably retaining said mouth portion and the opposite end portion at least of the sack closest to the rotary path defined by said filling spouts;

k. means to orient said sacks while in said magazine to define an angle of inclination with a horizontal plane greater than the corresponding angle of inclination of said filling spouts such that when each successive filling spout enters the next successive sack in said magazine and said filling spout lifts said sack from said magazine in a manner such that the end portion opposite said mouth portion lifts away from the next successive sack prior to lifting the mouth portion thereof; and i. means for discharging said sack from said filling spout when said sack is filled to a predetermined level.

* * * * *

UNITED STATES PATENT AND TRADEMARK OFFICE

CERTIFICATE OF CORRECTION

PATENT NO. : 4,019,546

DATED : April 26, 1977

INVENTOR(S) : Niels E. Hastrup

It is certified that error appears in the above-identified patent and that said Letters Patent are hereby corrected as shown below:

Column 1, line 41, "removed after" should read -- removed manually after --

Claim 17 b., Column 9, line 6, "positions radial" should read -- positions generally radial --

Claim 23, Column 9, line 64, "claim 2 wherein" should read -- claim 22 wherein --

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*